US005179263A

United States Patent [19]

Koh et al.

[11] Patent Number: 5,179,263

[45] Date of Patent: Jan. 12, 1993

[54] IMAGE FIXING APPARATUS WITH OVERSHOOT PREVENTION MEANS

[75] Inventors: Shokyo Koh, Yokohama; Yoshihiko Suzuki, Tokyo, both of Japan

[73] Assignee: Canon Kabushiki Kaisha, Tokyo, Japan

[21] Appl. No.: 502,223

[22] Filed: Mar. 29, 1990

[30] Foreign Application Priority Data

Mar. 31, 1989 [JP] Japan ..... 1-80378

[51] Int. Cl.[5] ..... H05B 1/02

[52] U.S. Cl. ..... 219/216; 219/492; 219/497; 219/505; 355/286

[58] Field of Search ..... 219/216, 491, 494, 501, 219/497, 499, 505, 492, 508, 509; 355/285, 286

[56] References Cited

U.S. PATENT DOCUMENTS

| | | | |
|---|---|---|---|
| 3,578,797 | 5/1971 | Hodges | 263/3 |
| 3,946,200 | 3/1976 | Juodikis | 219/499 |
| 4,002,882 | 1/1977 | McCutchen | 219/499 |
| 4,348,583 | 9/1982 | Bube et al. | 219/499 |
| 4,415,800 | 11/1983 | Dodge et al. | 219/497 |
| 4,566,779 | 1/1986 | Coli et al. | 355/3 R |
| 4,700,052 | 10/1987 | Wolf et al. | 219/497 |
| 4,730,101 | 3/1988 | Mahon | 219/497 |
| 4,853,519 | 8/1989 | Tanaka et al. | 219/497 |

FOREIGN PATENT DOCUMENTS

| | | |
|---|---|---|
| 085950 | 8/1983 | European Pat. Off. . |
| 295901 | 12/1988 | European Pat. Off. . |
| 370520 | 5/1990 | European Pat. Off. . |
| 5128925 | 3/1976 | Japan . |
| 56144469 | 11/1981 | Japan . |
| 58209771 | 12/1983 | Japan . |

*Primary Examiner*—Mark H. Paschall

[57] ABSTRACT

An image fixing apparatus includes a heater; a film movable together with a recording material having a visualized image which is heated by the heater through the film; a temperature detecting element for detecting a temperature of the heater; control system for controlling power supply to the heater so as to provide a constant output of the temperature detecting element during fixing operation; wherein the control system controls the power supply to the heater in accordance with an output of the temperature detecting element from start of power supply to the heater to the temperature of the heater reaching a predetermined temperature.

11 Claims, 5 Drawing Sheets

IMAGE FIXING APPARATUS WITH OVERSHOOT PREVENTION MEANS

FIELD OF THE INVENTION AND RELATED ART

The present invention relates to an image fixing apparatus for heat-fixing a visualized image on a recording material. In a widely used conventional image fixing apparatus wherein the toner image is fixed on the recording material supporting an unfixed toner image, the recording medium is passed through a nip formed between a heating roller maintained at a predetermined temperature and a pressing or back-up roller having an elastic layer and press-contacted to the heating roller. In addition, a belt type fixing system is known as disclosed in U.S. Pat. No. 3,578,797 and Japanese Patent Application Publication No. 28925/1976.

The conventional heating roller or belt fixing system, a large thermal capacity is required with the result that the waiting period until the surface of the heating roller or the belt reaches a predetermined temperature is long. In addition, the large thermal capacity requires large electric power.

In order to solve these problems, U.S. Ser. No. 206,767, filed Jun. 15, 1988 proposes a novel image fixing apparatus using a low thermal capacity heating member and a thin film. U.S. application Ser. No. 206,767 has been assigned to the assignee of this application. In the disclosed apparatus, the fixing temperature is quickly reached after the start of the energization of the heater, and therefore, no waiting period is necessary. Since the fixing apparatus uses a low thermal capacity heater, the temperature of the heater overshoots an amount corresponding to the time lag which is due to the distance between the heating portion and the portion where the temperature detecting element is mounted or due to the delay in the response of the temperature detecting element, when the heat generating member is energized up to the fixing temperature. Although the time lag is not long, the amount of overshoot is large because the low thermal capacity of the heater leads to high temperature rising speed. If the amount of the overshoot is too much, the fixing film may be damaged.

In the heating roller fixing type or the like having the large thermal capacity, the overshooting is prevented by deenergizing of the heater for a predetermined period of time when the temperature of the surface of the heating roller reaches a predetermined temperature which is lower than the fixing temperature.

However, with the low thermal capacity heater, the temperature of the heating member quickly decreases when the energization is stopped, and therefore, it is not difficult to employ the measurement against the overshooting used in the heating roller fixing type, that is, deenergization at a certain point of time during the warming up period.

SUMMARY OF THE INVENTION

Accordingly, it is a principal object of the present invention to provide an image fixing apparatus which can be quickly started with suppressed overshooting.

It is another object of the present invention to provide an image fixing apparatus wherein the energy application can be controlled in accordance with the temperature of the heater.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The preferred embodiments of the present invention will be described in conjunction with the accompanying drawings.

Figure 2:
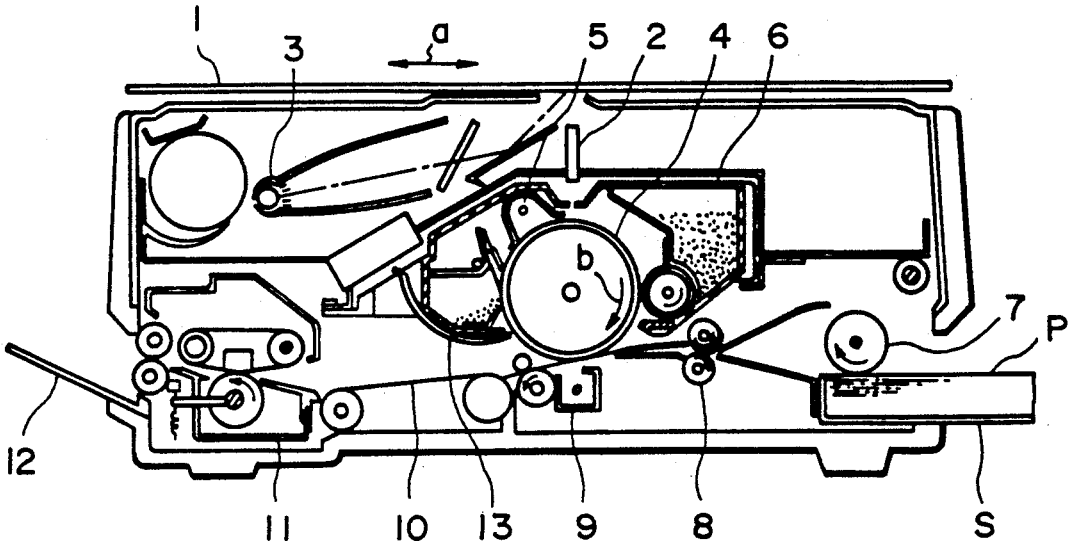
FIG. 2 is a sectional view of an image forming apparatus according to an embodiment of the present invention.

Referring to FIG. 2, there is shown an image forming apparatus including an image fixing apparatus according to an embodiment of the present invention. The image fixing apparatus comprises an original supporting platen made of transparent material such as glass or the like which is reciprocable in a direction of an arrow a. Below the original supporting platen 1, there is disposed an array 2 of short focus small diameter imaging elements. The original placed on the original supporting platen 1 is illuminated by an illumination lamp 3, and the light image by the reflected light is projected through the array 2 onto a photosensitive drum 4 through a slit. The photosensitive drum 4 rotates in the direction indicated by an arrow b. The apparatus further comprises a charger 5 which functions to uniformly charge the photosensitive drum 4 which is made of zinc oxide photosensitive layer or a organic semiconductor photosensitive layer. The photosensitive drum 4 uniformly charged by the charger 5 is exposed to the image light through the array 2, so that an electrostatic latent image is formed thereon. The electrostatic latent image is visualized by the developing device 6 with powdery toner made of heat-fusing or heat-softening resin. On the other hand, a transfer material (sheet) P (recording material) accommodated in a cassette S is fed to the photosensitive drum 4 by a pick-up roller 7 and a pair of conveying rollers 8 which are rotatable in press-contact with each other with a timed relation with the image on the photosensitive drum 4. The toner image formed on the photosensitive drum 4 is transferred onto the transfer material P by a transfer discharger 9. Thereafter, the transfer material P is separated from the photosensitive drum 4 by a known separating means and is introduced into an image fixing device 11 along a conveyance guide 10. The fixing device 11 heat-fixes the toner image, and the transfer material P is discharged to the tray 12. After the toner image is transferred, the residual toner on the photosensitive drum 4 is removed by a cleaner 13.

Figure 3:
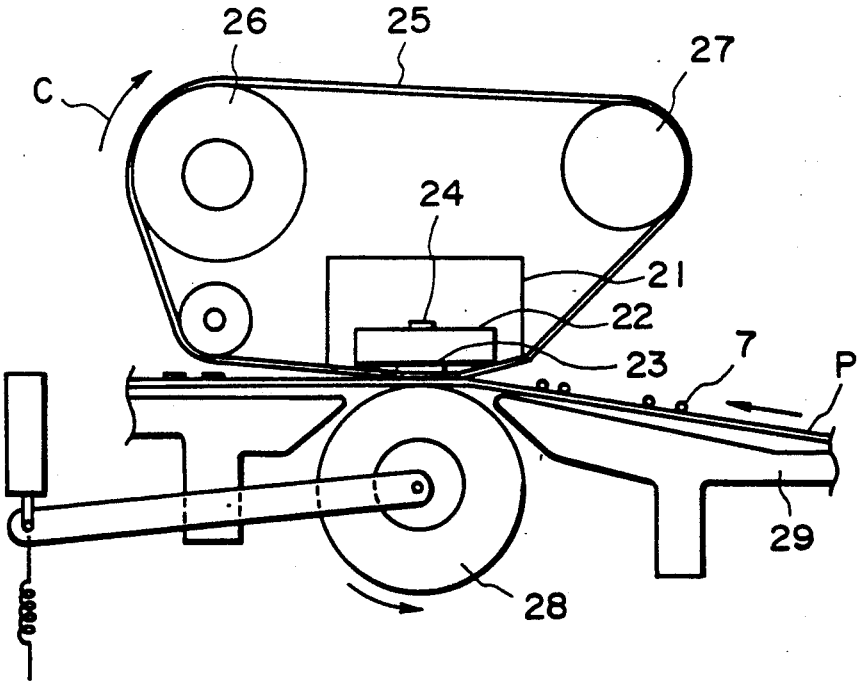
FIG. 3 is an enlarged sectional view of an image fixing apparatus according to the embodiment of the present invention.

Referring to FIG. 3, the description will be made as to the fixing device according to the embodiment of the present invention. FIG. 3 is an enlarged view of the fixing device contained in the apparatus of FIG. 2. The image fixing device comprises a linear heating member having a low thermal capacity and fixedly mounted on the apparatus. The heating member 21 includes a base member 22 made of highly heat conductive alumina having a thickness of 1.0 mm, a width of 10 mm and a length of 240 mm, for example, and a resistor material 23 capable of generating heat upon electric energization and having a width of 1.0 mm. It is connected to the power source at the longitudinal opposite ends. The energization is in the form of a pulse wave having a period of 20 msec of DC 100 V. It further comprises a temperature detecting element 24 for detecting the temperature of the heating member during the fixing operation, the width of the energization pulse is controlled substantially in accordance with the energy radiation of the heating member so that the temperature detecting element 24 detects a constant temperature. The pulse width changes between 0.5–5 msec by the control. The temperature detecting element 24 detects the temperature of the heat generating resistor 23 through the alumina base plate having the high thermal conductivity.

A heat-resistive fixing film 25 moves in the direction of an arrow C in sliding contact with the heating member 21 maintained at the constant temperature. The fixing film 25 has a heat-resistive base film having a thickness of 20 microns, for example, and made of polyimide, polyetherimide, PES, PFA or the like and a parting layer having a thickness of 10 microns which is smaller than that of the base film applied at least on such a surface of the base film as is contactable to the image. The parting layer is made of PTFE added with conductive material. The fixing film 25 is in the form of an endless film.

In order to sufficiently reduce the thermal capacity to enable the quick start, the total thickness of the fixing film 25 is preferably not more than 100 microns, further preferably not more than 50 microns.

The fixing film 25 is mentioned between a driving roller 26 and a follower roller 27 and is driven by the driving roller 26 in the direction C without wrinkle. A pressing roller 28 has a rubber elastic layer made of a material having good parting property such as silicone rubber. It presses the heating member 21 through the film 25 at the total pressure of 4–7 kg, so that it rotates in press-contact with the film 25. The transfer material P having thereon an unfixed toner image T is introduced into the fixing position along an inlet guide 29, and the toner image T is fixed by the heating operation described above.

The fixing apparatus of this embodiment is applicable to an image fixing apparatus such as a printer or facsimile as well as the electrophotographic copying apparatus shown in FIG. 2.

Figure 1:
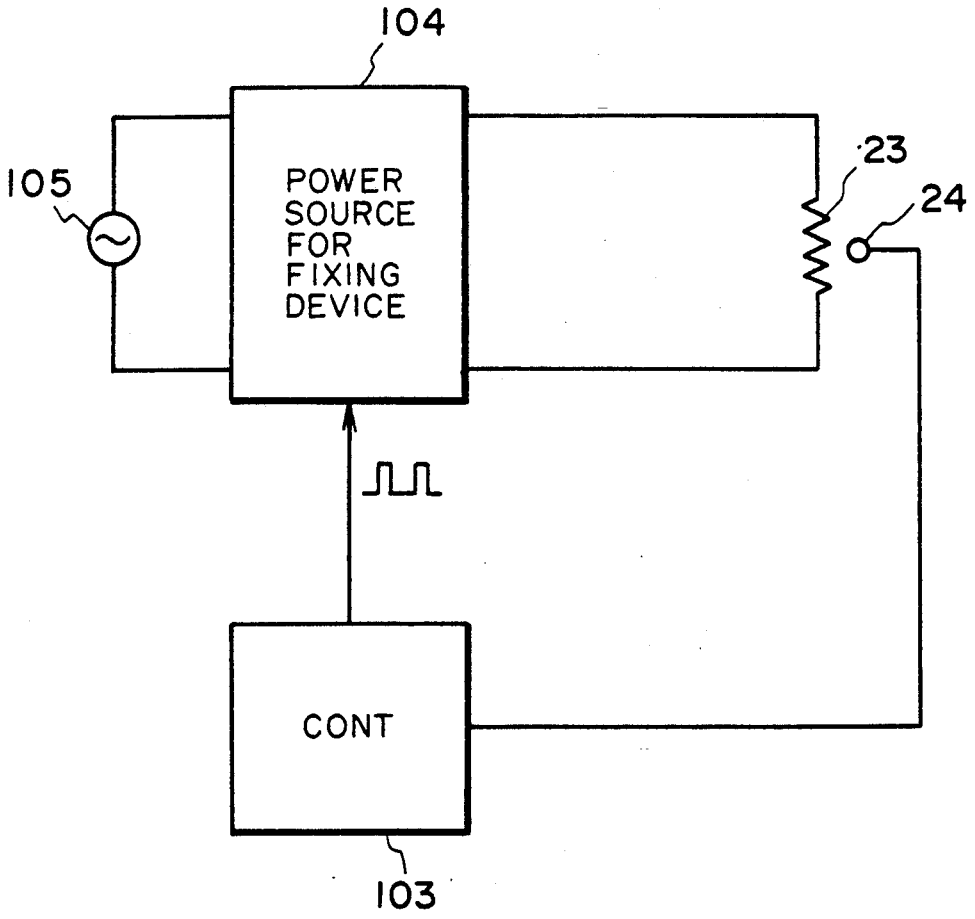
FIG. 1 is a block diagram of a system according to an embodiment of the present invention.

Referring now to FIG. 1, there is shown a block diagram of the system of this embodiment. As described, the heat generating resistor 21 is formed on an alumina base plate 22 made of a small thermal capacity insulator. The temperature detecting element 24 in the form of a thermister is mounted to the backside of the alumina base plate 22 adjacent to the heat generating resistor 21. The system comprises a control device 103. Designated by reference numerals 104 and 105 are a power source for the fixing device and a utility AC power source, respectively. In accordance with an output signal of the thermister 24 (temperature detecting element) disposed adjacent the heat generating element 23, the output pulse is changed by the control device 103, so that the energy application to the heat generating element 23 is controlled. The fixing device power source 104 converts an AC voltage from the utility AC source 105 to a DC voltage, and pulsewisely energize the heat generating element 23 in accordance with a pulse output of the control device 103. During the fixing operation, the control is such that the temperature of the heat generating element 23 is constant. As will be explained hereinafter, the temperature in increased from a room temperature to a fixable temperature (fixing temperature) in approximately 5 sec.

Figure 4:
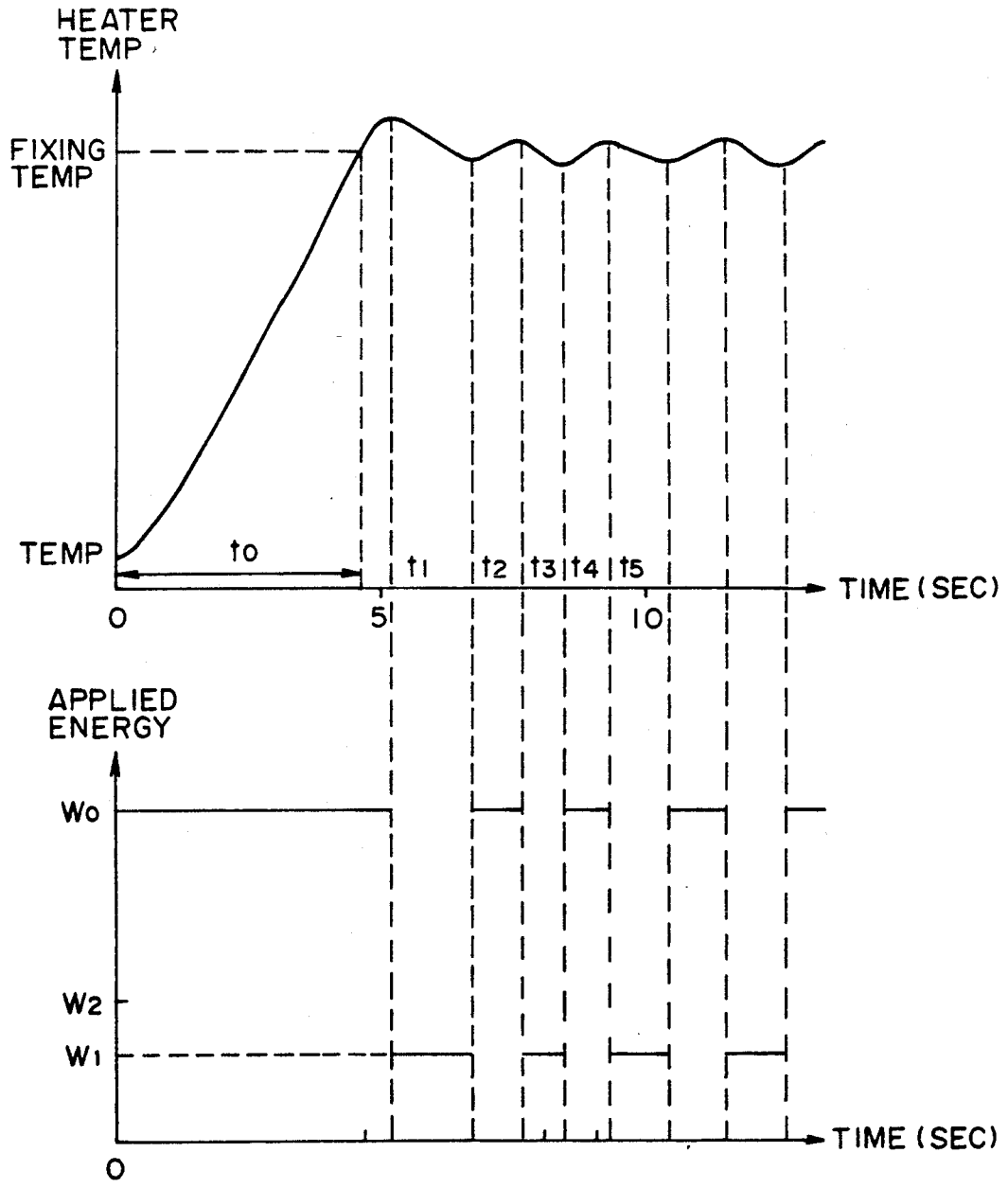
FIG. 4 shows temperature rising characteristics of the heat generating member in a comparison example.

FIG. 4 shows the relation between the energization of the heat generating element and a temperature rise in a comparison example which is a background of the present invention. More particularly, it shows the temperature rising characteristics of the heat generating element in connection with the energy supply, when the present invention is not used. In this Figure, W2 represents energy taken out by the fixing film, the transfer material and the pressing roller; W0 represents the energy applied until the fixing temperature is reached. When the heat generating element has a temperature higher than the fixing temperature, the energy W1 which is smaller than the energy W2 is applied, by which the ripple of the heat generating element temperature during the control.

Experiments by the inventors have revealed that the overshooting and the temperature ripple of the heat generating element temperature decreases with the energy W0 reaching the energy W2. However, the time $t_0$ required for raising the temperature from the room temperature to the fixing temperature becomes longer. The temperature detected by the thermister 24 is delayed as compared with the actual surface temperature of the heat generating element 23 due to the delay in the response of the thermister 24 itself and the thermal resistance from the heat generating portion to the thermister 24, or the like. It crosses the fixing temperature at the points of time $t_1$, $t_2$, $t_3$, . . . Since the heat generating element 23 has the low thermal capacity, the surface temperature of the heat generating element 23 decreases as soon as the application energy reduces from W0 to W1, and on the contrary, it increases as soon as the energy application rises from W1 to W2.

In the heating roller type fixing device, in order to prevent the overshooting, the energy is intermittently supplied until the fixing temperature is reached. However, as to the heat generating element of the fixing device using the film and the low thermal capacity heating member, the surface temperature decreases as soon as the energy application is stopped, and therefore, this system is not preferable.

Figure 5:
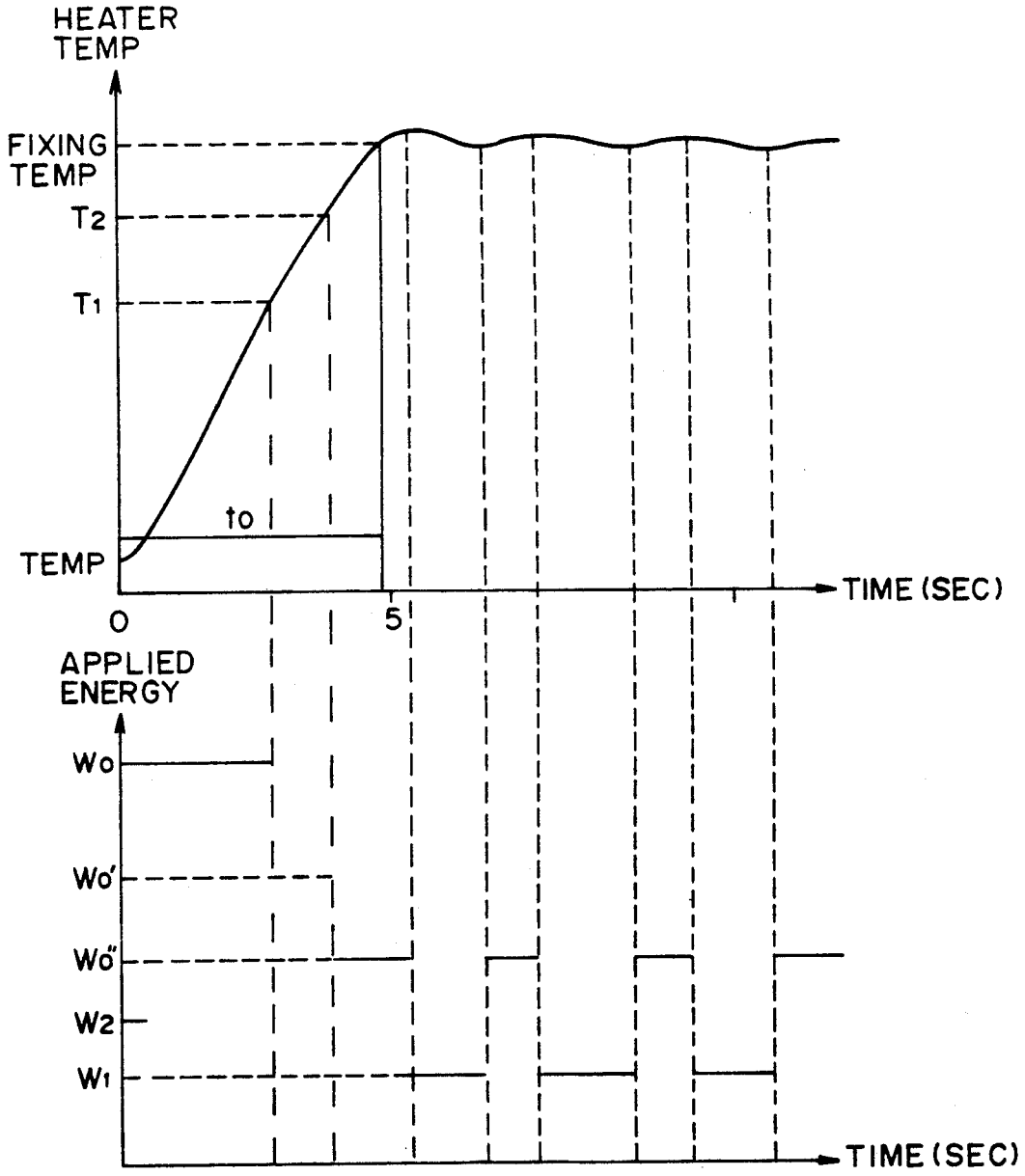
FIG. 5 shows a temperature rising characteristics of the heat generating member according to an embodiment of the present invention.

As shown in FIG. 5, in this embodiment, the energy supply is stepwisely changed in accordance with the temperature of the heat generating element 23 until the temperature of the heat generating member 23 reaches the predetermined fixing temperature. In FIG. 5, when an unshown copy switch is depressed in the image forming apparatus of FIG. 2, so that an image formation start signal is generated, the energy W0 is supplied to the heat generating element. The energy W0 is supplied until the temperature of the heat generating element reaches T1. Until a temperature T2 which is higher than the temperature T1 is reached, energy W0′ which is lower than the energy W0 is supplied; and until the fixing temperature which is higher than the temperature T2 is reached, energy W0″ which is further lower than the energy W0′ is supplied By properly selecting the temperatures T1, T2, energy W0, W0′, W0″, the time period $t_0$ required for reaching the fixing temperature can be made approximately 5 sec.

In the image forming apparatus of FIG. 2, the time required for the recording material to reach the fixing nip from the start of the image formation is approximately 10 sec which is longer than 5 sec, and therefore, the quick start is possible wherein the image forming operation is started as soon as the main switch is actuated.

In this embodiment, after the heat generating element reaches the fixing temperature, it is supplied with the energy W1 which is smaller than the energy W2 when the heat generating element has the temperature which is higher than the predetermined fixing temperature, whereas when it is lower than the fixing temperature, it is supplied with the energy W0″ which is smaller than the energy W0 and larger than the energy W2. By doing so, the ripple can be reduced during the constant temperature control, as compared with FIG. 4 example.

Figure 6:
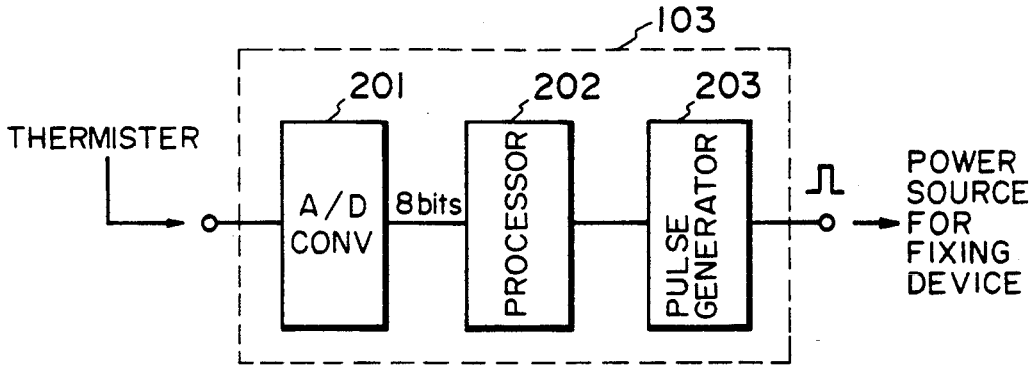
FIG. 6 illustrates a control device shown in FIG. 1.

FIG. 6 is a block diagram showing details of the control device 103 used in the apparatus of FIG. 1. The control device comprises a one chip microcomputer. The output of the thermister is supplied to an AC/DC (AD) converter 201, so that it is converted to a digital signal and is then transmitted to a processing circuit 202. The processing circuit 202 produces pulse data corresponding to the above-described energy, in accordance with the digital signal. The pulse data are supplied to a pulse generating circuit 203, which produces pulses in accordance with the pulse data received thereby.

Figure 7:
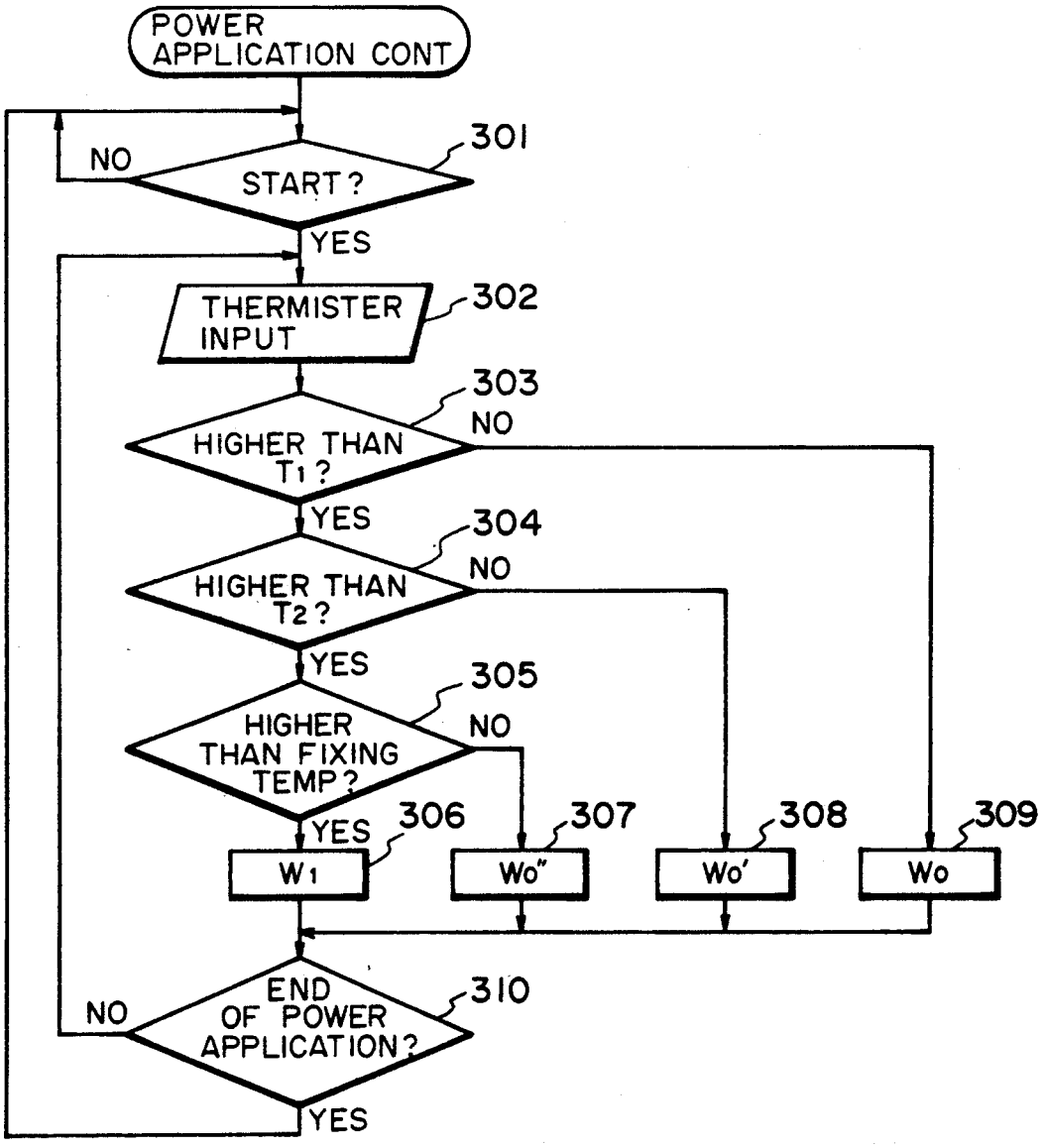
FIG. 7 is a flow chart illustrating an operation of the control device of FIG. 6.

FIG. 7 is a flow chart illustrating the control operation carried out by the control device 103. When an image formation starting signal is produced, and the energy supply to the heat generating element 23 is started at step 301, the output of the thermister 24 is converted to digital signals by the AC/DC converter 201, and the digital signal is read in at step 302. If the digital signal represents a temperature lower than the temperature T1, the pulses corresponding to the energy W0 are produced at step 309. If the digital signal represents a temperature which is higher than the temperature T1 and lower than the temperature T2 (step 304), the pulses corresponding to the energy W0′ (step 308) are supplied. If it represents a temperature which is higher than the temperature T2 and lower than the fixing temperature, the pulses corresponding to the energy W0″ (step 307) are produced. If the signal represents a temperature higher than the fixing temperature, the pulses corresponding to the energy W1 (step 306) are produced. At step 310, the discrimination is made as to whether the energization is to be stopped or not. If not, the step 302 is executed. If so, the energization is stopped, and the operation returns to the step 301.

In this manner, the energy supply can be stepwisely changed. The energy supply can be continuously changed in accordance with the heat generating element temperature, but the stepwise change is preferable because the control system is not complicated.

In the image forming apparatus shown in FIG. 2, the energy supply to the heat generating element is started at the start of the image forming operation. However, in the case where the heat generating resistor has a quicker temperature rise property, and/or the image forming apparatus has a slower image formation speed, the energy supply to the fixing device may be started at a certain point of time after the start of the image formation, using the passage of the recording material at a certain position of the image forming apparatus.

While the invention has been described with reference to the structures disclosed herein, it is not confined to the details set forth and this application is intended to cover such modifications or changes as may come within the purposes of the improvements or the scope of the following claims.

What is claimed is:

1. An image fixing apparatus, comprising:

a heater, a film movable together with a recording material having a visualized image to transfer heat from said heater to the visualized image, a temperature detecting element for detecting a temperature of said heater, and control means for controlling electric power supply to said heater in accordance with a temperature detected by said temperature detecting element to maintain a fixing temperature of said heater during a fixing operation;

wherein after a start of power supply to said heater, said control means reduces the electric power with an increase of the temperature detected by said temperature detecting element, and after the detected temperature reaches the fixing temperature, said control means further reduces electric power to said heater to decrease the temperature of said heater.

2. An apparatus according to claim 1, wherein said control means stepwisely changes the power supply.

3. An apparatus according to claim 1, wherein said heater has a high thermal conductivity.

4. An apparatus according to claim 1, wherein said heater includes a heat generating resistance layer for generating heat by electric power supply and a base plate of high thermal conductivity for supporting said heat generating resistance layer, wherein said temperature detecting means detects a temperature of said base plate.

5. An apparatus according to claim 1, wherein said heater is supplied with the power in the form of electric pulses.

6. An apparatus according to claim 1, wherein said heater is stationary during the fixing operation, and wherein said film slides on said heater.

7. An apparatus according to claim 1, wherein said film has a thickness of not more than 100 microns.

8. An apparatus according to claim 1, further comprising a back-up member for urging the recording material and said film to said heater.

9. An apparatus according to claim 8, wherein minimum energy supplied to said heater after the start of the power supply and before the reaching the fixing temperature is larger than energy transferred from said heater to said film, the recording material and said back-up member.

10. An apparatus according to claim 1, wherein when said temperature detecting means detects a temperature beyond the fixing temperature after the power supply to said heater, said control means further reduces the power supply while not stopping the power supply.

11. An apparatus according to claim 10, further comprising a back-up member for urging the recording material and said film to said heater, wherein when the temperature of said heater is higher than the fixing temperature, energy of the power supply is smaller than energy transferred to said film, the recording material and said back-up member.

* * * * *

UNITED STATES PATENT AND TRADEMARK OFFICE

CERTIFICATE OF CORRECTION

PATENT NO. : 5,179,263

DATED : January 12, 1993

INVENTOR(S) : KOH et al.

It is certified that error appears in the above-identified patent and that said Letters Patent is hereby corrected as shown below:

Title page, item

[56] REFERENCES CITED

Insert: --Attorney, Agent or Firm - Fitzpatrick, Cella, Harper & Scinto--

Title page, under [56]

FOREIGN PATENT DOCUMENTS

"5128925" should read --51-28925--.
"56144469" should read --56-144469--.
"58209771" should read --58-209771--.

COLUMN 1

Line 17, "The" should read --In the--.
Line 59, "warming up" should read --warming-up--.

COLUMN 2

Line 46, "a" should read --an--.

UNITED STATES PATENT AND TRADEMARK OFFICE

CERTIFICATE OF CORRECTION

PATENT NO. : 5,179,263

DATED : January 12, 1993

INVENTOR(S) : KOH et al.

It is certified that error appears in the above-identified patent and that said Letters Patent is hereby corrected as shown below:

COLUMN 4

Line 7, "pulsewisely energize" should read --pulsewise energizes--.

Line 57, "stepwisely" should read --stepwise--.

COLUMN 5

Line 56, "stepwisely" should read --stepwise--.

COLUMN 6

Line 30, "stepwisely" should read --stepwise--.

Signed and Sealed this

Twenty-first Day of December, 1993

Attest:

Bruce Lehman

BRUCE LEHMAN

Attesting Officer

Commissioner of Patents and Trademarks